US009114857B2

(12) United States Patent
Miller et al.

(10) Patent No.: US 9,114,857 B2
(45) Date of Patent: Aug. 25, 2015

(54) EASY-UP SWIM HANDLES

(76) Inventors: Rodger E. Miller, Chesapeake Beach, MD (US); Carol E. Cook, Chesapeake Beach, MD (US)

( * ) Notice: Subject to any disclaimer, the term of this patent is extended or adjusted under 35 U.S.C. 154(b) by 0 days.

(21) Appl. No.: 13/137,601

(22) Filed: Aug. 29, 2011

(65) Prior Publication Data

US 2012/0048174 A1 Mar. 1, 2012

Related U.S. Application Data

(60) Provisional application No. 61/377,508, filed on Aug. 27, 2010, provisional application No. 61/457,586, filed on Apr. 25, 2011.

(51) Int. Cl.
*B63B 17/00* (2006.01)
*B63B 27/14* (2006.01)

(52) U.S. Cl.
CPC ..... *B63B 27/146* (2013.01)

(58) Field of Classification Search
USPC ..... 114/362, 364, 218
IPC ..... B63B 27/14,27/146
See application file for complete search history.

(56) References Cited

U.S. PATENT DOCUMENTS

| | | | | |
|---|---|---|---|---|
| 2,669,733 | A * | 2/1954 | Picker | 114/362 |
| 4,672,909 | A * | 6/1987 | Sweetsir | 114/218 |
| 5,813,504 | A * | 9/1998 | Iny et al. | 190/116 |
| 7,444,954 | B1 * | 11/2008 | Resta | 114/362 |
| 2008/0087211 | A1 * | 4/2008 | Sutherland et al. | 114/364 |
| 2008/0314310 | A1 * | 12/2008 | Little et al. | 114/364 |

* cited by examiner

*Primary Examiner* — Stephen Avila
(74) *Attorney, Agent, or Firm* — William H. Holt

(57) ABSTRACT

Various designs and arrangements of preferably tubular handle members are detachably mounted upon the swim platform of a boat for aiding swimmers to enter and/or exit from the water. In one embodiment the handles have an end, or ends, thereof slidably mountable within a tubular portion of a socket member that is preferably secured in a counter-sunk fashion in the swim platform. In a further embodiment handles are provided with an end lug for detachably mounting the handle to a mounting plate. When not in use, the handle members are slidably detached from the mounting members thereby providing an unencumbered surface on the swim platform.

13 Claims, 6 Drawing Sheets

EASY-UP SWIM HANDLES

RELATED APPLICATIONS

Provisional Application 61/377,508 filed Aug. 27, 2010 and Provisional application 61/457,586 filed Apr. 25, 2011.

BACKGROUND OF THE INVENTION

Pleasure crafts, in the nature of small power boats and/or sail boats, have been provided with a swim platform for accommodating swimmers for entering and exiting the water while the craft is anchored or free floating. The swim platform is usually at the stern of the craft, but it may also be located along a side or front thereof. A number of devices have been designed in the form of a ladder, or the like, and proposed for attachment to the swim platform and may be extendable into the water and below the surface thereof for assisting in entering or, primarily, for exiting the water and climbing upon the swim platform.

Generally speaking, such devices fall short of providing a reasonably safe means for prevention of slips and falls on the wet surface of the swim platform which can result in severe injury.

SUMMARY OF THE INVENTION

The present invention provides several forms and styles of handles which are designed for being securely affixed upon conventional swim platforms and readily detached therefrom for storage and the like thereby resulting in an unobstructed surface on the swim platform when the handles are not in use.

DESCRIPTION OF PREFERRED EMBODIMENTS

Figure 1:
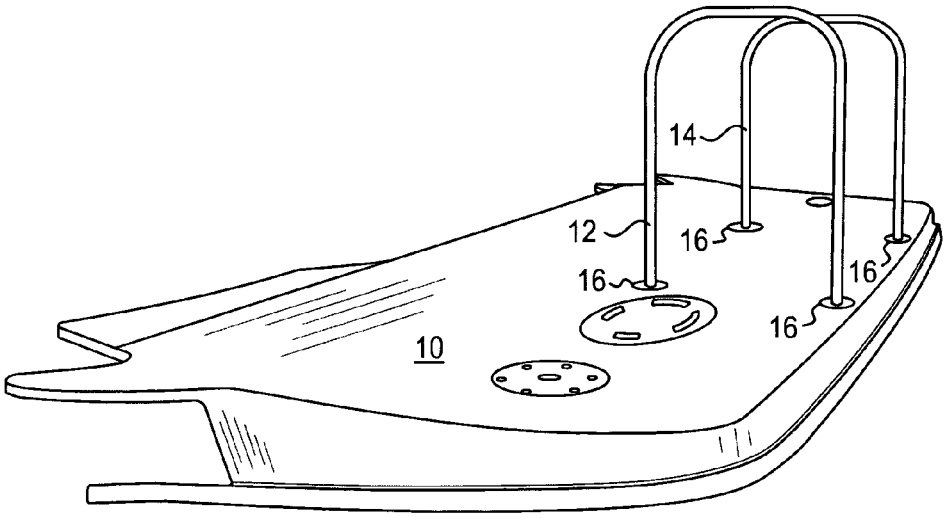
FIG. 1 is a perspective view of a typical swim platform which, for simplicity, is shown unattached to a boat and includes a pair of U-shaped handles mounted thereon adjacent to the stern portion and showing the ends of the handles assembled upon the swim platform.

FIG. 1 shows a swim platform 10 which, in a known manner, is to be attached unto the stern of a power boat or sail boat (not shown). Such platforms are known in the prior art and are useful for aiding swimmers to enter the water and return to the boat safely. An example of a similar swim platform is shown in U.S. Pat. No. 4,907,673. The top surface of the platform 10 is usually in a wet and somewhat slippery condition; this can readily lead to slips and falls with consequent injury.

In order to preclude or minimize injury to swimmers, and/or boatmen, a pair of tubular, U-shaped handles 12 and 14 are shown in FIG. 1 as being placed parallel to each other in a vertical, upstanding, spaced relation and have their ends mounted in a series of securing or socket members 16 that are recessed within and secured to the swim platform 10. Handles 12 and 14 are located adjacent an edge of the platform 10 in a position that they can be readily grasped by a swimmer who wishes to exit the water and climb upon the swim platform 10 of the boat. It is known in the prior art to provide a ladder or an arrangement of steps that can be secured to a swim platform, or to the boat, but such devices are not part of the present invention.

It is to be understood that the ends of handles 12 and 14 are not fixedly secured to the securing or socket members 16. Rather, as will be later explained in more detail, the ends of handles 12 and 14 are slidably received in the sockets 16 and are easily removed therefrom to allow for safe storage upon the boat, thus leaving the top surface of swim platform 10 in a smooth and unencumbered condition.

Figure 2:
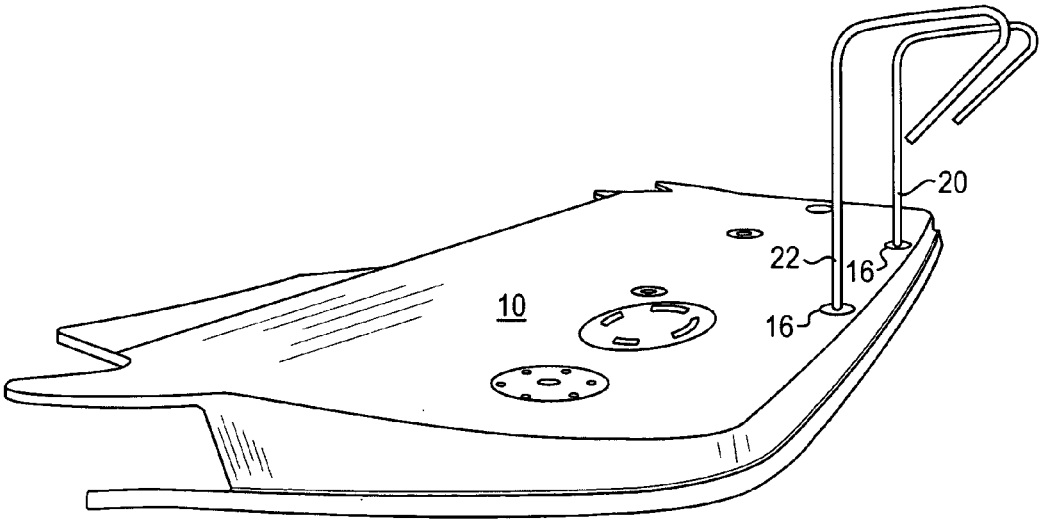
FIG. 2 is a perspective view of a swim platform similar to the showing in FIG. 1 and showing a pair of generally P-shaped handles, each having one end thereof mounted near the marginal portion of the swim platform.

FIG. 2 shows a pair of generally P-shaped handles 20 and 22 arranged in parallel fashion upon swim platform 10 and having their lower ends slidable mounted within socket members 16 in a like manner to the arrangement in FIG. 1. The embodiment of FIG. 2 reduces the number of necessary socket members 16 to only two, rather than four as shown in FIG. 1. Of course, costs involved in recessing the socket members 16 into the swim platform are also halved.

Figure 3:
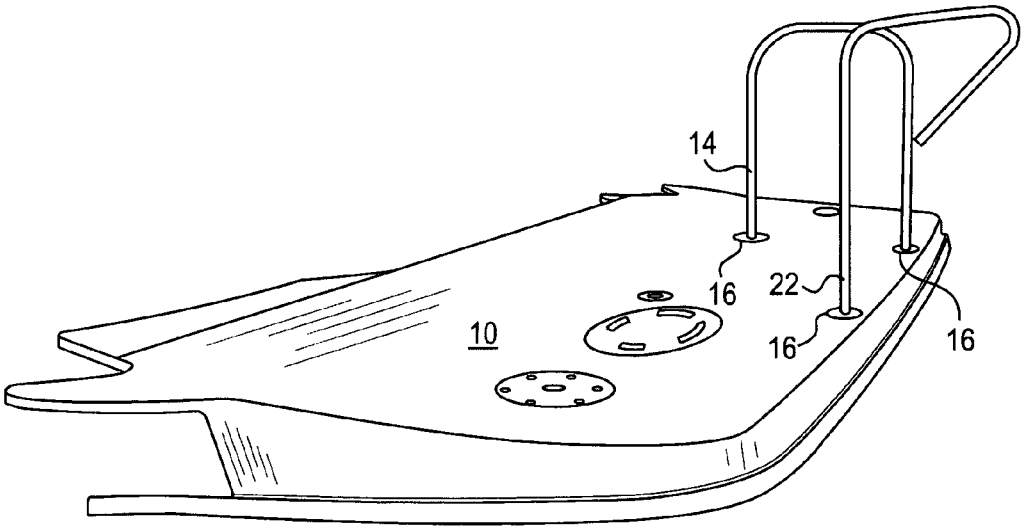
FIG. 3 is a perspective view similar to FIGS. 1 and 2 showing an embodiment of the invention wherein a combination of a U-shaped handle and a P-shaped handle provide a modified arrangement of handles for assisting a swimmer to exit from the water and gain access to the swim platform and the boat.

FIG. 3 illustrates a further modification of the invention wherein a single U-shaped handle 14 is used in combination with a single P-shaped handle 22. This arrangement allows for handle 22 to be rotatable toward and away from the U-shaped handle 14 which is stable, and non-rotatable, because the lower two ends are located within a pair of socket members 16. This arrangement allows a person standing upon swim platform 10 to hold onto U-shaped handle 14 to aid and assist a swimmer holding onto P-shaped handle 22 while exiting the water.

Figure 4:
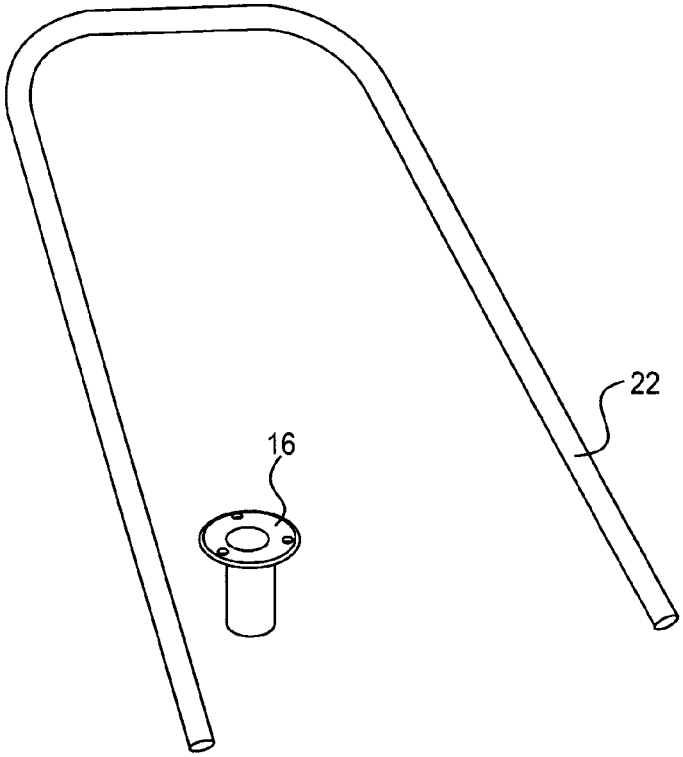
FIG. 4 illustrates a U-shaped handle and an accompanying flanged socket member that is used for providing a mounting, or securing member, to which an end of the handle is readily insertable into and detachable therefrom.

FIG. 4 shows a U-shaped handle 22 and a socket member 16 separated from each other.

Figure 5:
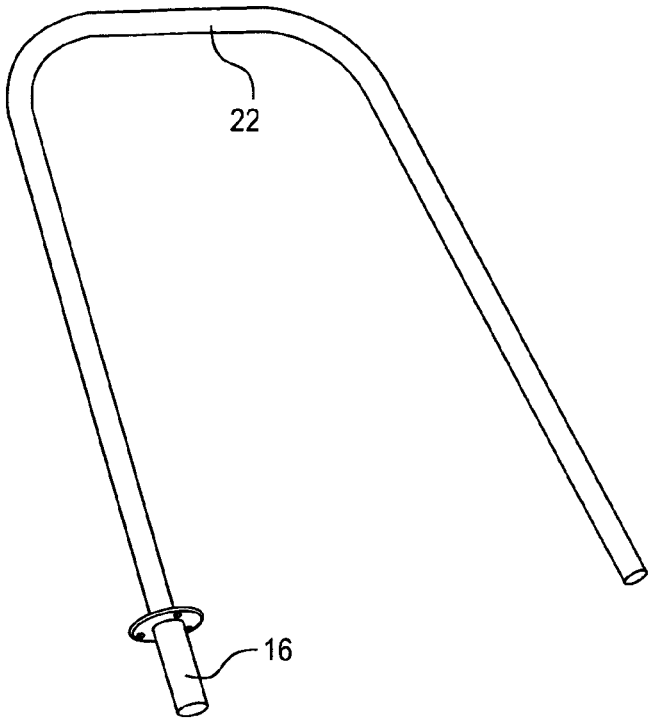
FIG. 5 illustrates the socket member having one end of the handle being slidably received therein.

FIG. 5 shows a U-shaped handle 22 having a socket member 16 slidably mounted upon one end of handle 22.

Figure 6:
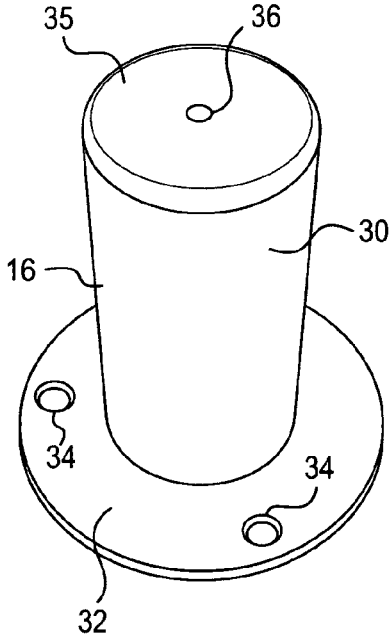
FIG. 6 illustrates a flanged socket member located in an upside down position for showing a drain hole in the bottom surface thereof for allowing water to escape from the interior volume of the socket member.
Figure 7:
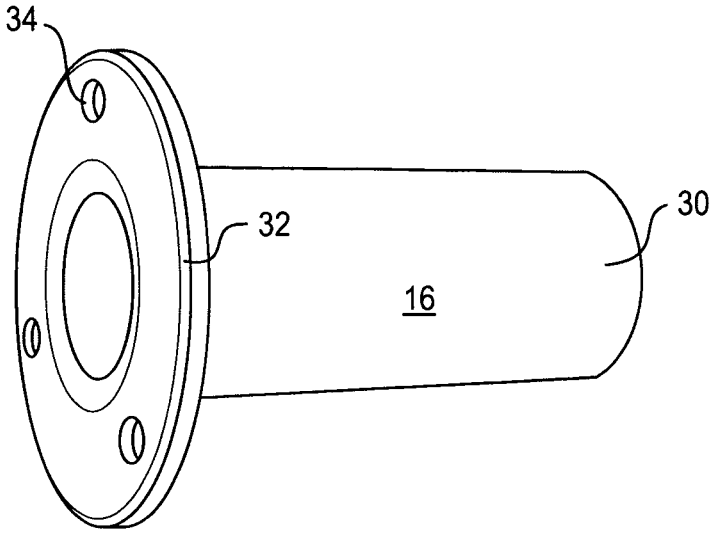
FIG. 7 is a side view of the flanged socket member showing the hollow interior thereof and a plurality of holes for receiving bolts to secure the socket member to the swim platform as shown in FIGS. 1-3.
Figure 8:
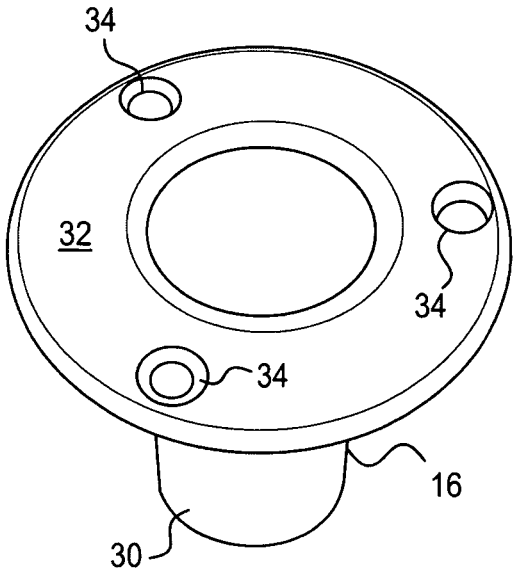
FIG. 8 shows a socket member in an upright position prior to being counter-sunk below a surface of the swim platforms of FIGS. 1-3.

FIGS. 6, 7 and 8 are perspective views showing details of a socket member 16 which is preferably formed of stainless steel but which may be constructed from other metals or plastics and preferably is provided with a protective coating such as a wear resistant epoxy, or the like. Socket member 16 is comprised of a hollow, cylindrical, tubular stem 30 having a flange portion 32 integral therewith, such as by being welded or swaged thereto, or formed integral by a stamping operation, or molded from metal or plastic. Flange 32 may be provided with a plurality of holes 34 to accommodate either bolts or screws for attaching socket member 16 to the upper surface of swim platform 10. As is best shown in FIG. 6, socket member 16 is shown in an upside down position to show a closed end 35 which provides strength to the tubular stem 30, limits travel of the lower end of the handles 12, 14, 20 and 22, and includes a drain hole 36 passing through closed end 35 for allowing water to drain from tubular stem 30.

Figure 9:
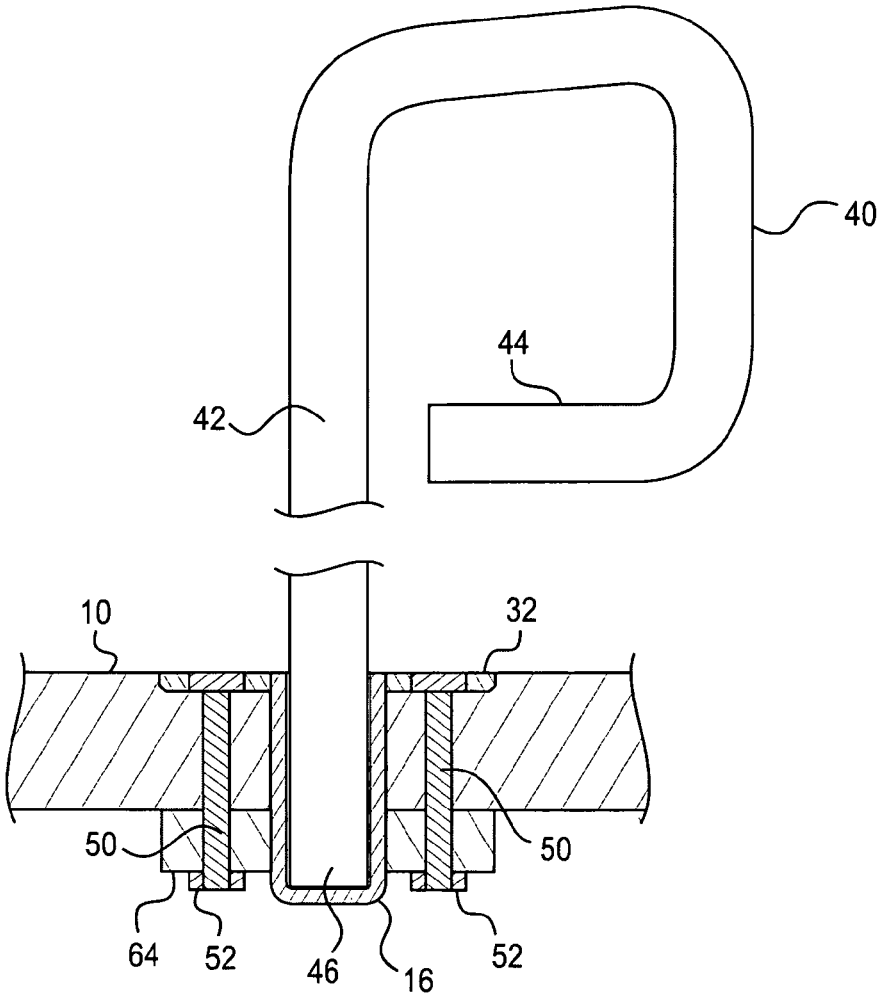
FIG. 9 is a fragmentary view, partly in section of a modified design of a P-shaped handle and shows one end thereof being slidably mounted within a socket member that is countersunk within a swim platform and secured thereto by a plurality of threaded nuts and bolts which cooperate with a lowermost support ring for securely clamping the socket member to the swim platform.

FIG. 9 illustrates a modified handle design wherein a generally P-shaped handle 40 includes a vertical leg 42 for being slidably and rotatably located in socket member 16 and a reversely turned arm 44 having a free end located closely adjacent to vertical leg 42 for forming a substantially closed loop for handle 40. Leg 42 is shown as being shorter in length than the arms shown in FIGS. 1-5 thereby providing a lower profile.

FIG. 9 also shows details of the manner in which socket member 16 is mounted within swim platform 10. It is seen that a plurality of threaded fasteners, such as bolts 50, are counter-sunk within flange 32 and pass through holes 34 (see FIGS. 6-8) for providing a smooth upper surface and are secured at their lower end by threaded nuts 52. It is preferred that a reinforcing plate member 64 is provided for effectively clamping the socket member 16 to the swim platform 10.

Figure 10:
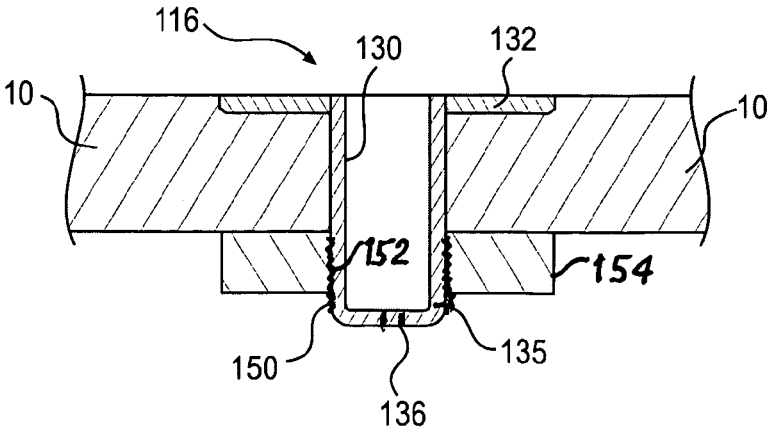
FIG. 10 illustrates a modified arrangement of a flanged socket member having exterior screw threads formed on a tubular portion adjacent a lower portion thereof for cooperating with internal screw threads formed on the interior cylindrical surface of a support ring surrounding and reinforcing the lower portion of the socket member.

FIG. 10 shows a modified socket member 116, partly in section, to be located within and secured to the swim platform 10 for receiving a lower end of the various, previously described handles. As shown, socket member 116 includes a depending, hollow stem 130, a closed end 135 having a drain hole 136 therethrough, and an upper flange member 132. Stem 130 includes a threaded portion 150 at a lowermost, outer portion thereof for cooperating with internal threads 152 provided within a reinforcing plate member 154. Threading plate member 154 onto stem 130 effectively secures socket member to the swim platform 10 without a requirement for the nuts and bolt required by the socket member 16.

Figure 12:
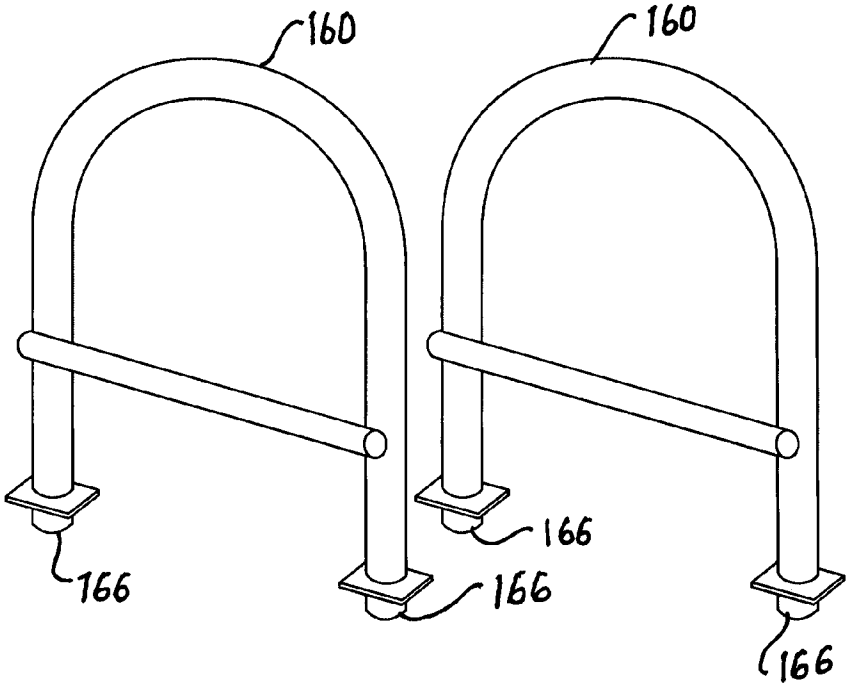
FIG. 12 illustrates handle members that are provided with a securing lug for use with the plate member of FIG. 11.
Figure 11:
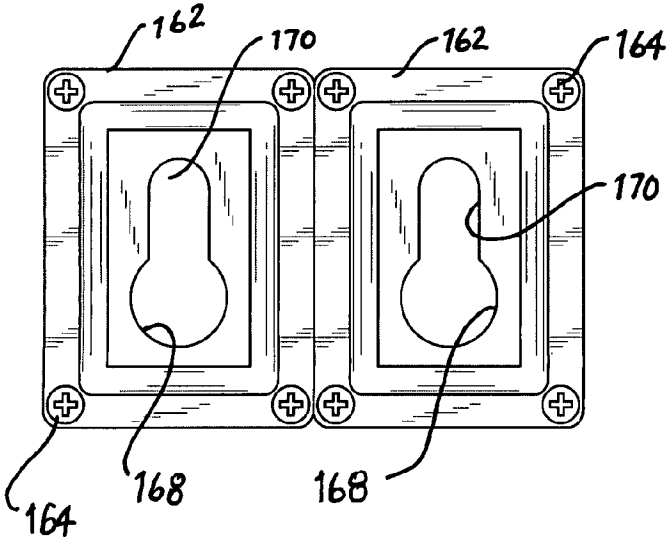
FIG. 11 illustrates a further embodiment wherein a securing member, or plate member, includes a varied size slot for receiving and securing a lug portion of a handle.

FIGS. 11 and 12 show a modified form of the invention wherein U-shaped railings or handles 160 cooperate with individual mounting or securing members in the form of plate members 162 that can be secured to the swim platform 10 of FIG. 1 by a plurality of bolt members 164. The railings or handles 160 are shown in FIG. 12 as having generally enlarged knobs, or lugs, 166 which are adapted to be inserted into enlarged openings 168 of the plate members 162 and then slid into narrow openings 170 such that the lugs 166 releasably secure the handles 160 to the plate members 162. While U-shaped handles 160 are shown in FIG. 12 as each having a pair of lugs 166, it is to be understood that only a single lug may be used. Likewise, P-shaped handles similar to handles 20 and 22 in FIG. 3 can be used and provided with only a single lug 166 for being secured to a plate member 162.

Various modifications to the foregoing described elements of the invention may become obvious to those skilled in the respective art without departing from the spirit and scope of the invention as defined by the appended claims.

We claim:

1. Apparatus for being attached to a swim platform of a boat, said apparatus being comprised of at least one handle member for aiding an individual to enter and exit from the water and to climb aboard said boat, and having at least one mounting member for each said handle member, each said mounting member having means for securing it to said swim platform and including an opening for slidably and releasably receiving an end of said handle member, said end of said handle member being readily insertable into said mounting member for ease of mounting said handle member and being readily, slidably, removed from said mounting member by simply lifting said handle member from said mounting member without the need of removing fasteners for placing said handle member in storage, whereby said swim platform has an unobstructed surface when said handle member is not in use; said mounting member being comprised of a cup-shaped member having a tubular portion providing said opening for slidably receiving said end of said handle member, said mounting member including an outwardly extending flange member at one end thereof for securing said mounting member to said swim platform; said flange containing a plurality of openings for receiving threaded fasteners for securing said mounting member to said swim platform; said flange member being counter-sunk into the surface of said swim platform for providing an unobstructed surface; said apparatus further including a pair of handle members, wherein one handle member is U-shaped and a second handle member is P-shaped, and said U-shaped member includes a pair of end portions which are attachable to said swim platform for precluding rotation thereof.

2. Apparatus as defined in claim 1 wherein said cup-shaped member includes a closed end for providing strength to said tubular portion, and an opening in said closed end for proving an outlet for allowing water to drain therefrom.

3. Apparatus as defined in claim 1 wherein said tubular portion contains exterior screw threads thereon, and said apparatus further includes an internally threaded support ring for securing said cup-shaped member to said swim platform.

4. Apparatus as defined in claim 1 wherein said mounting member is comprised of a plate member including a varied sized slot, and said handle having a lug portion on at least one end thereof for slidably fitting within said varied sized slot for detachably mounting said handle upon said plate member.

5. Apparatus as defined in claim 1 wherein said handle member is U-shaped, and each end thereof is mounted within a cup-shaped member for precluding rotation of said U-shaped handle.

6. Apparatus as defined in claim 1 wherein said handle member is P-shaped, and one end thereof is mounted within a cup-shaped member for allowing rotation of said handle member therein.

7. Apparatus for being attached to a swim platform of a boat, said apparatus being comprised of at least one handle member for aiding an individual to enter and exit from the water and to climb aboard said boat, and having at least one mounting member for each said handle member, each said mounting member having means for securing it to said swim platform and including an opening for slidably and releasably receiving an end of said handle member, said end of said handle member being slidably insertable into said mounting member for ease of mounting said handle member and being readily, slidably, removable from said mounting member by simply lifting said handle member from said mounting member without the need of removing fasteners for placing said handle member in storage, whereby said swim platform has an unobstructed surface when said handle member is not in use; said mounting member being comprised of a cup-shaped member having a tubular portion providing said opening for slidably receiving said end of said handle member, said mounting member including an outwardly extending flange member at one end thereof for securing said mounting member to said swim platform.

8. Apparatus as defined in claim 7 wherein said flange contains a plurality of openings for receiving threaded fasteners for securing said mounting member to said swim platform; said flange member being counter-sunk into the surface of said swim platform for providing an unobstructed surface.

9. Apparatus as defined in claim 7 wherein said cup-shaped member includes a closed end for providing strength to said tubular portion, and an opening in said closed end for proving an outlet for allowing water to drain therefrom.

10. Apparatus as defined in claim 7 wherein said tubular portion contains exterior screw threads thereon, and said apparatus further includes an internally threaded support ring for securing said cup-shaped member to said swim platform.

11. Apparatus as defined in claim 7 wherein said mounting member is comprised of a plate member including a varied sized slot, and said handle having a lug portion on at least one end thereof for slidably fitting within said varied sized slot for detachably mounting said handle upon said plate member.

12. Apparatus as defined in claim 7 wherein said handle member is U-shaped, and each end thereof is mounted within a cup-shaped member for precluding rotation of said U-shaped handle.

13. Apparatus as defined in claim 7 wherein said handle member is P-shaped, and one end thereof is mounted within a cup-shaped member for allowing rotation of said handle member therein.

* * * * *